US008343285B2

(12) United States Patent
Buchmeier et al.

(10) Patent No.: US 8,343,285 B2
(45) Date of Patent: Jan. 1, 2013

(54) METHOD FOR CARRYING OUT A RINSING PROGRAMME

(75) Inventors: Willi Buchmeier, Mettmann (DE); Joerg Kinnius, Spenge (DE); Christian Nitsch, Duesseldorf (DE); Dirk Wegener, Bielefeld (DE); Cornelius Wolf, Bielefeld (DE); Johannes Zipfel, Duesseldorf (DE)

(73) Assignees: Miele & Cie. KG, Guetersloh (DE); Henkel AG & Co. KGAA, Duesseldorf (DE)

( * ) Notice: Subject to any disclaimer, the term of this patent is extended or adjusted under 35 U.S.C. 154(b) by 690 days.

(21) Appl. No.: 12/518,390

(22) PCT Filed: Nov. 15, 2007

(86) PCT No.: PCT/EP2007/009865

§ 371 (c)(1),
(2), (4) Date: Jun. 9, 2009

(87) PCT Pub. No.: WO2008/071283

PCT Pub. Date: Jun. 19, 2008

(65) Prior Publication Data

US 2010/0018556 A1 Jan. 28, 2010

(30) Foreign Application Priority Data

Dec. 12, 2006 (DE) ..... 10 2006 058 793

(51) Int. Cl.
*B08B 3/00* (2006.01)

(52) U.S. Cl. ..... 134/25.2; 134/18; 134/26

(58) Field of Classification Search ..... 134/25.2, 134/26, 18

See application file for complete search history.

(56) References Cited

U.S. PATENT DOCUMENTS

| | | | | |
|---|---|---|---|---|
| 5,545,346 | A * | 8/1996 | MacBeath et al. | 510/514 |
| 6,345,633 | B1 * | 2/2002 | Tartakovsky et al. | 134/25.2 |
| 6,372,702 | B1 * | 4/2002 | Chiou et al. | 510/222 |
| 6,453,917 | B1 | 9/2002 | Biechele | |
| 6,462,007 | B1 * | 10/2002 | Pieroni et al. | 510/224 |
| 2006/0048795 | A1 | 3/2006 | Kornberger et al. | |
| 2008/0283091 | A1 | 11/2008 | Steiner et al. | |
| 2009/0000644 | A1 | 1/2009 | Druecker et al. | |

FOREIGN PATENT DOCUMENTS

| | | |
|---|---|---|
| DE | 10024014 | 1/2001 |
| DE | 10049489 | 4/2002 |
| DE | 10220839 | 12/2003 |
| DE | 10230567 | 1/2004 |
| DE | 102004043657 | 3/2006 |
| DE | 102005059343 | 6/2007 |
| EP | 1245180 | 10/2002 |
| EP | 1362547 | 11/2003 |
| EP | 1652463 | 5/2006 |

OTHER PUBLICATIONS

International Seach Report or PCT/EP2007/009865, mailed Apr. 7, 2008.*

* cited by examiner

*Primary Examiner* — Saeed T Chaudhry
(74) *Attorney, Agent, or Firm* — Leydig, Voit & Mayer, Ltd.

(57) ABSTRACT

A method for carrying out a dishwashing cycle in a household dishwasher includes performing a wash step and dispensing an amount of a combination product from a dispenser during the wash step. The combination product includes a rinse agent and a cleaning agent. The method also includes performing a rinse step and dispensing an amount of the combination product from the dispenser during the rinse step.

9 Claims, No Drawings

METHOD FOR CARRYING OUT A RINSING PROGRAMME

CROSS REFERENCE TO RELATED APPLICATIONS

This is a U.S. National Phase application under 35 U.S.C. §371 of International Application No. PCT/EP2007/009865, filed on Nov. 15, 2007, and claims the benefit of German Patent Application No. DE 10 2006 058793.6, filed on Dec. 12, 2006. The International Application was published in German on Jun. 19, 2008 as WO 2008/071283 A1 under PCT Article 221(2).

FIELD

The present invention relates to a method for carrying out a dishwashing cycle in a household dishwasher, in which a combination product is dispensed during the wash step.

BACKGROUND

Dishwashers which are adapted for the use of both conventional detergents and combination products are described in DE 100 49 489 A1, DE 102 20 839 A1, DE 102 30 567 A1, and in EP 1 362 547 A2. These combination products are generally referred to as "2in1" and "3in1" tabs, which, in addition to detergent, also contain rinse aid (2in1) or rinse aid and water softener salt substitutes (3in1). Some of these products work according to the carry-over principle, in which an excessive amount of rinse aid dissolves at the beginning of the dishwashing cycle and in which the actually needed amount is to be carried over to the rinse cycle by entrainment and adhesion to the dishes. In other products, the rinse aid is integrated as a wax-encapsulated pearl, the wax being intended to dissolve as a function of temperature or pH value not before the rinse cycle in order to release the rinse aid. The dishwashers described in DE 100 49 489 A1, DE 102 20 839 A1 and DE 102 30 567 A1 are adapted to the use of such products by means for blocking the supply of rinse aid from the dispensing system, which is usually located in the door of the dishwasher.

In cycles in which the wash water is at a high temperature during the wash step already, the aforementioned products do not work satisfactorily because the rinse aid contained in the tablet is already dissolved in the wash water and is discharged therewith at the end of the wash step. Hence, the absence of rinse aid during the final rinse step results in poor drying performance. In accordance with German document DE 10 2004 043 657 A1, this problem is overcome by adding a small amount of rinse aid from a corresponding dispenser during the rinse step. The requirement of having to fill liquid rinse aid into a corresponding dispenser even when a combination product containing a rinse agent is used is not readily comprehensible to the user, leading to operator errors.

European document EP 1 652 463 A1 describes a method for dispensing a multi-component detergent additive in a water-using domestic appliance. In that disclosure, a solid combination product containing a rinse agent in addition to a cleaning agent is stored in a container provided for this purpose. Different agents are then dissolved from this combination product during individual steps of an operating cycle.

SUMMARY

It is, therefore, an aspect of the present invention to provide a method for carrying out a dishwashing cycle, which will enable satisfactory drying results to be achieved without additional rinse aid.

In an embodiment, the present invention provides a method for carrying out a dishwashing cycle in a household dishwasher. The method includes performing a wash step and dispensing a first amount of a combination product from a dispenser during the wash step. The combination product includes a rinse agent and a cleaning agent. The method also includes performing a rinse step and dispensing a second amount of the combination product from the dispenser during the rinse step.

DETAILED DESCRIPTION

In accordance with the present invention, the drying results are improved by dispensing of combination product during the rinse cycle. Surprisingly, the cleaning component contained in the product does not affect the cleaning and drying results; i.e., no residues are left on the dishes. This is especially true if the amount of combination product dispensed during the rinse step is smaller than that dispensed during the wash step.

Ease of dispensing can be achieved by using a combination product in liquid or gel-like form. In this case, it is possible to use a dispensing system in which the cleaning component and the bleach component of the liquid detergent can be stored separately.

A household dishwasher suitable for carrying out the method of the present invention has a dispensing system in which the cleaning component and the bleach component of liquid detergent compositions can be stored separately. The appliance should advantageously have a control allowing the selection of both "normal" dishwashing cycles and "2in1" or "3in1" cycles for combination products. In a dishwasher of this type, a generally known dishwashing cycle is executed, including the cycle steps of "pre-rinse", "wash", "intermediate rinse", "final rinse" and "drying". During the wash step, first a cleaning agent and then a bleaching agent is supplied to the washing tub. Both agents may be dispensed repeatedly in small quantities. If the detergent used is a combination product which, in addition to the detergent agent, contains a rinse aid ("2in1") or sometimes also a water softening agent ("3in1") or further agents, the user can block the supply of rinse aid from an also known rinse aid dispenser by pressing the "2in1" button or the "3in1" button. In this case, an additional amount of the combination product is supplied from the corresponding dispenser to the washing tub during the rinse step. It should be noted that the amount dispensed during the rinse step may be smaller than that dispensed during the wash step.

While the invention has been described with reference to particular embodiments, it should be understood that the invention is not limited to such configurations; reference should be had to the appended claims.

What is claimed is:

1. A method for carrying out a dishwashing cycle in a household dishwasher, the method comprising:

performing a wash step;

dispensing a first amount of a combination product from a dispenser during the wash step, the combination product including a rinse agent and a cleaning agent;

performing a rinse step; and dispensing a second amount of the combination product from the dispenser during the rinse step.

2. The method for carrying out a dishwashing cycle as recited in claim 1, further comprising performing at least one pre-rinse step before performing the wash step and the rinse step.

3. The method for carrying out a dishwashing cycle as recited in claim 1, further comprising performing at least one intermediate rinse step after performing the wash step and before performing the rinse step.

4. The method for carrying out a dishwashing cycle as recited in claim 1, further comprising performing a drying step following the wash step and the rinse step.

5. The method for carrying out a dishwashing cycle as recited in claim 1 wherein the second amount of the combination product is smaller than the first amount of the combination product.

6. The method for carrying out a dishwashing cycle as recited in claim 5 wherein the combination product is a liquid.

7. The method for carrying out a dishwashing cycle as recited in claim 5 wherein the combination product is a gel.

8. The method for carrying out a dishwashing cycle as recited in claim 1 wherein the combination product is a liquid.

9. The method for carrying out a dishwashing cycle as recited in claim 1 wherein the combination product is a gel.

* * * * *